US005827317A

United States Patent [19]

Hastings

[11] Patent Number: 5,827,317

[45] Date of Patent: Oct. 27, 1998

[54] BODY PIERCING HOLDER

[76] Inventor: Arthur C. Hastings, 31 Main St., Bass River, Mass. 02664

[21] Appl. No.: 834,450

[22] Filed: Apr. 15, 1997

[51] Int. Cl.[6] ..... A61B 17/34

[52] U.S. Cl. ..... 606/188; 606/185

[58] Field of Search ..... 606/188, 185

[56] References Cited

U.S. PATENT DOCUMENTS

| | | | |
|---|---|---|---|
| 4,030,507 | 6/1977 | Mann | 606/188 |
| 4,164,224 | 8/1979 | Hastings | 128/330 |
| 4,191,190 | 3/1980 | Hastings | 128/330 |
| 5,389,105 | 2/1995 | Mann | 606/188 |
| 5,496,343 | 3/1996 | Reil | 606/188 |

*Primary Examiner*—Michael H. Thaler
*Attorney, Agent, or Firm*—Wolf, Greenfield & Sacks, P.C.

[57] ABSTRACT

A member for holding a body piercing pin within a body piercing instrument, the pin having a head and shaft, the body piercing instrument comprising a U-shaped body portion having first and second legs extending from a resilient bight of the body portion, means for housing the member, the body piercing pin and a plunger adapted to engage the member, the housing means being mounted at an end of the first leg, and a locknut support mounted at an end of the second leg, the locknut support being adapted to receive a pointed end of the body piercing pin after it has been projected through a body part by the plunger.

2 Claims, 5 Drawing Sheets

BODY PIERCING HOLDER

BACKGROUND OF THE INVENTION

1. Scope of the Invention

This invention is directed to a disposable body piercing instrument adapted to dispense piercing pins having non-cylindrical heads.

2. Discussion of the Related Art

This invention is designed to facilitate the use of disposable piercing instruments such as the instrument disclosed in U.S. Pat. No. 4,164,224, which patent is commonly owned with the present application and is incorporated herein by reference in its entirety.

The piercing instrument illustrated in the aforementioned patent, illustrative of the type of body piercing instrument for which the invention herein is described and designed, is shown in FIG. 1. The body piercing instrument 100 includes a body portion 102, including a pair of jaws 104 and 106 connected by an integral bight 108. The free end of jaw 106 is provided with locknut support 110 designed to hold a locknut 112 of the type normally used in body piercing systems. The other jaw 104 is provided with means 114 for housing plunger 116, shown partially in phantom, and body piercing stud 118, also shown partially in phantom. Body piercing pin 118 includes a head portion 120 which is cylindrical in shape and a width which allows a friction fit of head 120 within bore 122 of housing means 114. Plunger 116 also has a diameter similar to the diameter of bore 122, to provide a friction fit between plunger 116 and housing means 114 when plunger 116 is inserted into bore 122. Plunger 116 engages head 120 of body piercing pin 118. In use, the operator normally places, for example, an earlobe between the point 124 of pin 118 and the locknut support 110. Piercing instrument 100 is then squeezed by applying pressure to the end of plunger 116 and the outer surface of locknut support 110. This causes piercing instrument 100 to compress to the position illustrated in FIG. 1B. Upon application of further pressure, a flange 116*a*, integrally formed on plunger 116, is sheared off, releasing plunger 116 for further movement toward jaw 106. On such movement, the body piercing pin 118 is suddenly released to pierce the earlobe and engage locknut 112. Pressure on piercing instrument 100 is released, allowing jaws 104 and 106 to separate. Piercing instrument 100 is then slide from engagement with the now interengaged pin 118 and locknut 110.

In this piercing instrument, head 120 of piercing pin 118 must have a diameter which enables a friction fit between head 120 and bore 122, a cylindrical surface and a height which provides enough surface area along the sides to hold piercing pin 118 in alignment with the direction of travel of plunger 116 when plunger 116 projects piercing pin 118 through the earlobe into locknut 112. This requirement that the sides of head 120 be cylindrical precludes the use of ball-headed body piercing pins, such as is shown in FIG. 2. The body piercing pin 218 of FIG. 2 includes ball-shaped head portion 226, shaft portion 228 and point 224. Since head 226 of body piercing pin 218 is not cylindrical in shape, body piercing pin 218 cannot be used in conjunction with an unmodified body piercing instrument 100.

Current styles now frequently demand use of piercing pins having heads with shapes other than cylindrical. In particular, use of pins having spherical heads have become popular.

It is therefore desirable to provide a body piercing pin holder which enables a body piercing pin having a ball-shaped head to be used with piercing instrument 100.

SUMMARY OF THE INVENTION

The present invention enables the use of ball-headed body piercing pins with a piercing instrument such as that illustrated in U.S. Pat. No. 4,164,224. The piercing instrument and a holder for a body piercing pin are disclosed. The piercing instrument includes means for supporting a plunger which engages the holder within the supporting means and a locknut support adapted to receive a pointed end of the piercing pin after it has been projected through a body part by the plunger.

The holder envelops a spherical head of the pin and holds the pin in place within the supporting means. The holder is made from a polyethylene material, is foldable along a center line thereof and comprises first and second identical halves positioned on either side of the center line. Each half of the holder includes an indentation in one side thereof, each indentation being substantially semi-spherical in shape. Each half of the holder further includes a semi-circular channel in one side, each channel extending from the indentation, away from the center line, to an outer edge of the holder.

The head is positioned in the indentation of the first half of the holder, with the shaft portion of the pin positioned in the channel of the first half of the holder and the second half of the holder is folded at the center line, the holder thereby enveloping the head and shaft of the pin between the indentation and channel of the first half and the indentation and channel of the second half, respectively.

When the pin is enveloped by the holder, the holder is substantially cylindrical in shape. The radius of the holder at a first end of the holder is greater than the radius of the holder at a second end of the holder. The holder holds shaft of the body piercing pin in alignment with a direction of travel of the plunger as the plunger projects the body piercing pin through the body part.

In another embodiment, a member for holding a body piercing pin within a body piercing instrument is disclosed. The pin has a head and shaft, and the body piercing instrument comprises a U-shaped body portion having first and second legs extending from a resilient bight of the body portion. A means for housing the member, the body piercing pin and a plunger adapted to engage the member, the housing means is mounted at an end of the first leg. A locknut support is mounted at the end of the second leg. The locknut support is adapted to receive a pointed end of the body piercing pin after it has been projected through a body part by the plunger.

The member includes first and second halves, which are symmetrical about a center line of the member, each half including an indentation and a channel for receiving the head and shaft of the body piercing pin, respectively. The member is foldable about the center line to enable the head and shaft of the body piercing pin to be received simultaneously by the indentations and channels, respectively, of the first and second halves of the member. When the member is folded to simultaneously receive the body piercing pin in the first and second halves, the member is substantially in the shape of a cylinder. When the member is folded and substantially in the shape of a cylinder, a radius of the cylinder at one end is greater than a radius of the cylinder at the other end.

In another embodiment of the invention, a holder for a body piercing pin having a non-cylindrical head is disclosed. The holder has a frusto-conic outer surface, a cavity within the holder to securely receive the head of the pin with the shaft thereof extending from the holder, and a hinge for opening the holder to insert and remove the pin.

BRIEF DESCRIPTION OF THE DRAWINGS

The foregoing and other objects and advantages of the invention will be understood more fully from the following detailed description, thereof with reference to the accompanying drawings, wherein.

DETAILED DESCRIPTION

FIGS. 3A–3D show the body piercing pin holder 10 of the present invention. Body piercing holder 10 is semi-cylindrical in shape and is formed from two halves 10*a* and 10*b* which are symmetrical about a cross hinge portion 12. Body piercing holder 10 is made of a suitable plastic which permits folding of the holder at hinge portion 12. Halves 10*a* and 10*b* are symmetrical about hinge portion 12 and include semi-spherical indentations 14*a* and 14*b* and channels 16*a* and 16*b*. Each channel 16*a* and 16*b* extends from indentation 14*a* and 14*b*, respectively, away from hinge portion 12 to end 18*a* and 18*b* of each of the halves 10*a* and 10*b*, respectively.

Figure 1A:
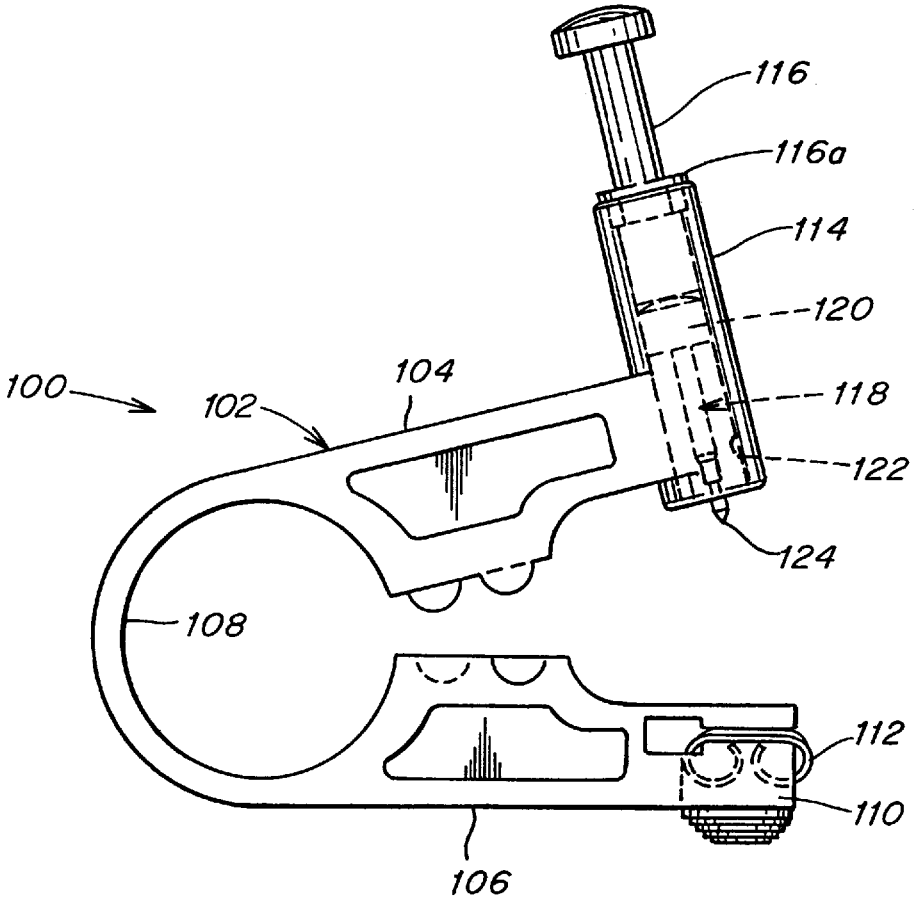
FIG. 1A (PRIOR ART)
FIG. 1A is a plan view of a conventional piercing instrument in an open position.
Figure 1B:
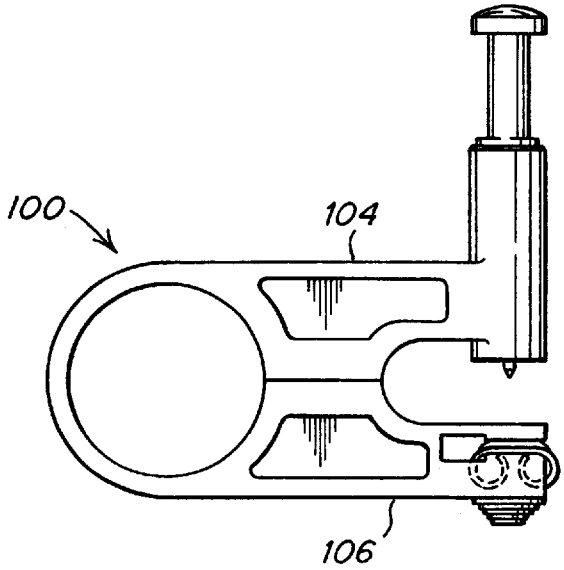
Fig. 1B (PRIOR ART)
FIG. 1B is a plan view of the conventional piercing instrument in a closed position.
Figure 2:
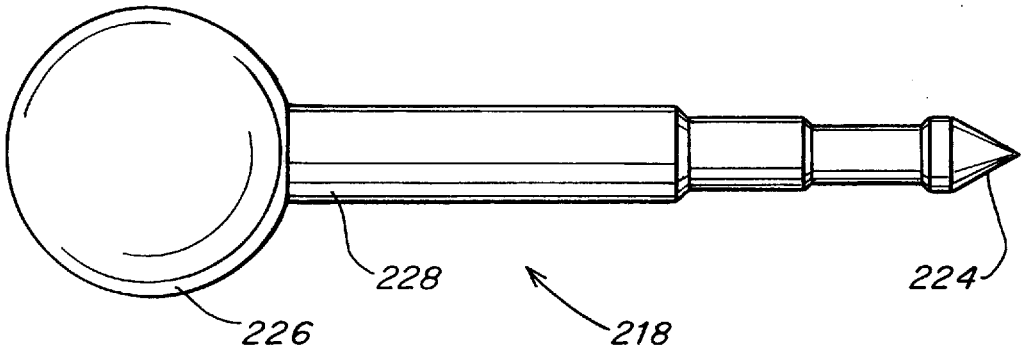
Fig. 2 (PRIOR ART)
FIG. 2 is a plan view of a conventional ball-headed pin.
Figure 3A:
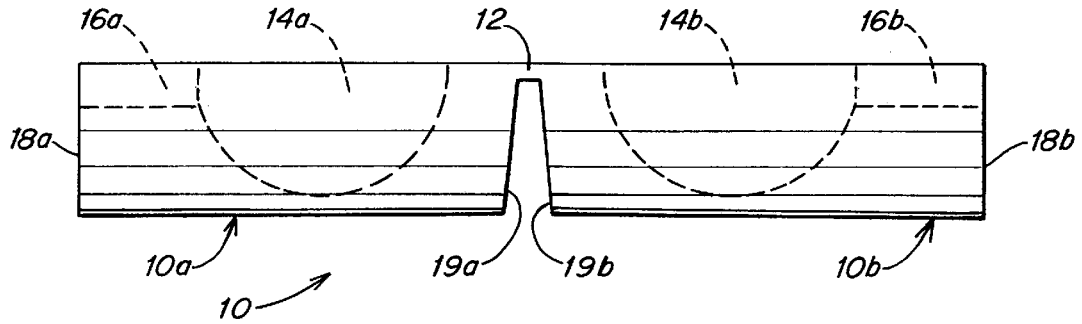
FIG. 3A is a side view of the body piercing pin holder of the present invention.
Figure 3B:
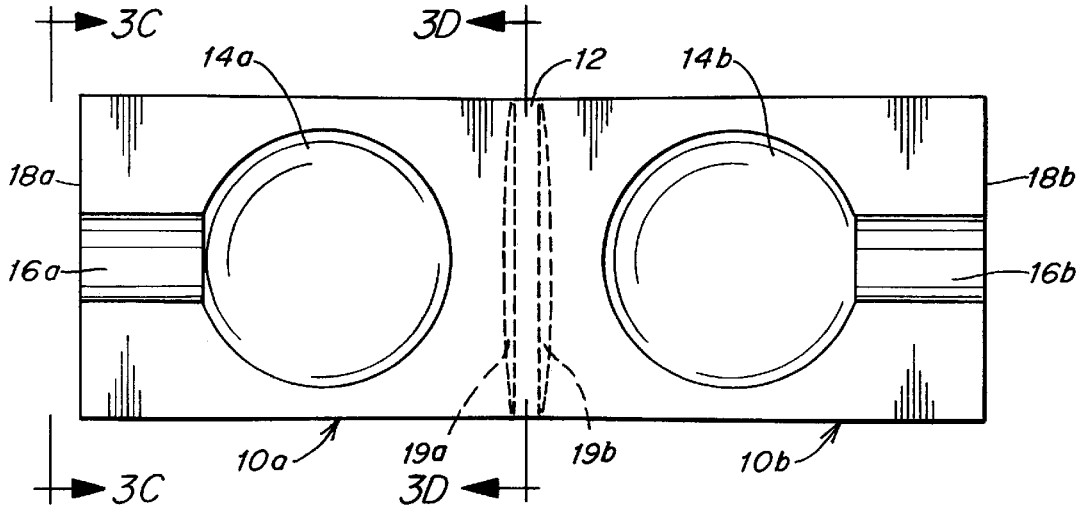
FIG. 3B is a top view of the body piercing pin holder of the present invention.
Figure 3C:
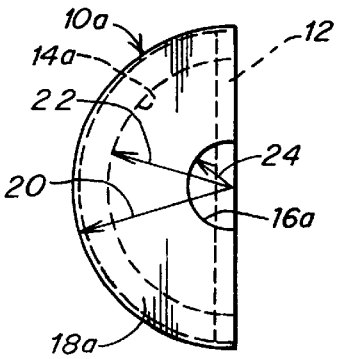
FIG. 3C is an end view of the body piercing pin holder of the present invention, as seen along line 3*c*—3*c* of FIG. 3B.

FIG. 3C is a side view of the body piercing pin holder 10 as seen along line 3*c*—3*c* of FIG. 3B. The radius 20 of body piercing pin holder 10 at end 18*a* is 1.981 mm. The radius of indentation of 14*b* which is shown in phantom in FIG. 3C, is 1.5875 mm, which is substantially equal to the radius of the head of body piercing pin 218. The radius 24 of channel 16*a* is 0.572 mm, which is substantially equal to the radius of shaft portion 228 of body piercing pin 218.

Figure 3D:
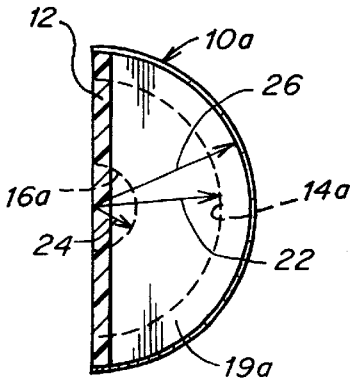
FIG. 3D is a sectional view of the body piercing pin holder, taken along line 3*d*—3*d* of FIG. 3B.

FIG. 3D is a sectional view of body piercing pin holder 10 taken along line 3*d*—3*d* of FIG. 3B. While radius 22 of indentation 14*b* and radius 24 of Channel 16*b* are constant, radius 26 of end 19*a* is 1.956 mm (compared to 1.981 mm for the radius of end 18*a*). Half 10*b* has the same dimensions as half 10*a*. The purpose of this slight tapering of halves 10*a* and 10*b* from ends 18*a* and 18*b* to ends 19*a* and 19*b* of holder 10 is discussed below.

Figure 4A:
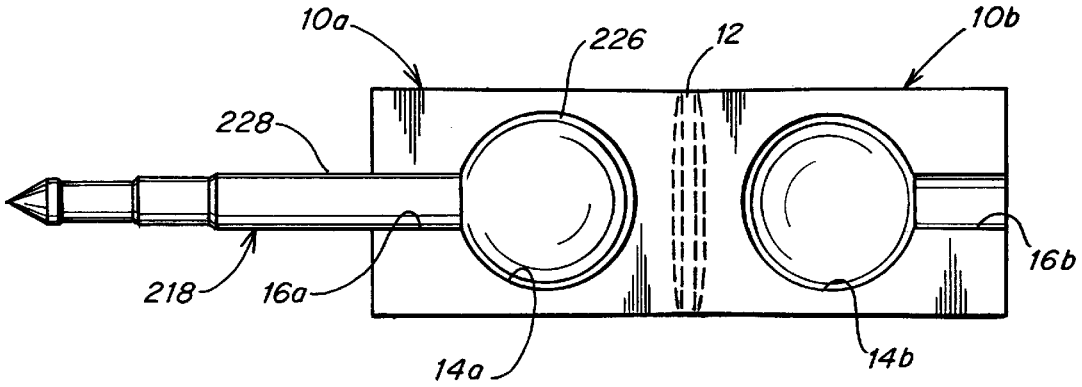
FIG. 4A is a top view of the body piercing pin holder with the body piercing pin positioned into one side of the body piercing pin holder.
Figure 4B:
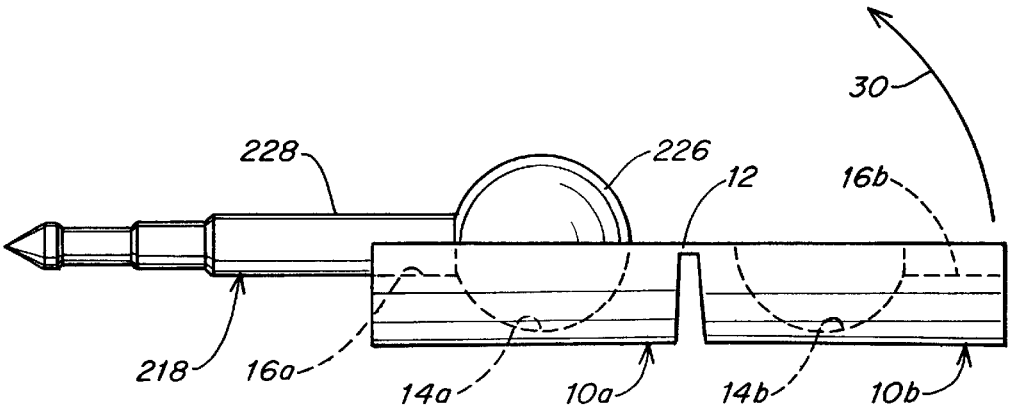
FIG. 4B is a side view of the body piercing pin holder with the body piercing pin installed into one side of the body piercing pin holder.

In use, head 226 of body piercing pin 218 is placed in indentation 14*a* and shaft portion 228 is place in channel 16*a* of half 10*a* of body piercing holder 10, as shown in FIG. 4A, which is a top view of holder 10 and pin 218. FIG. 4B is a side view of body piercing pin holder 10 having body piercing pin 218 installed. Body piercing holder 10 is then folded at hinge portion 12 by moving half 10*b* in the direction shown by arrow 30. Half 10*b* is folded over until head 226 and shaft 228 are enveloped between indentations 14*a* and 14*b* and channels 16*a* and 16*b*, respectively.

Figure 5:
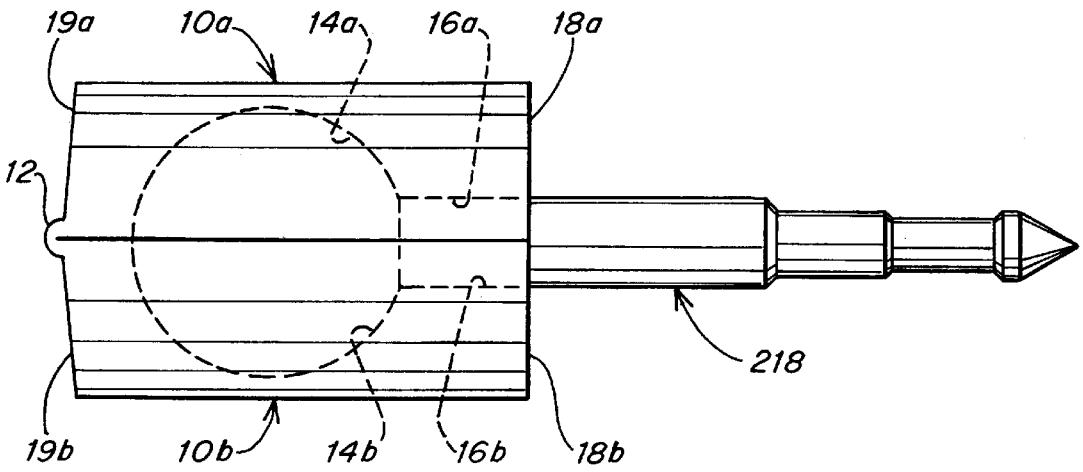
FIG. 5 is a side view of the body piercing pin holder and body piercing pin enclosed by the body piercing pin holder.

FIG. 5 shows body piercing pin 218 being held within body piercing pin holder 10. In this position, body piercing pin holder 10 is substantially cylindrical in shape. The combination of holder 10 and pin 218 then is inserted into bore 122 of piercing instrument 100. The radius of holder 10 along each of ends 18*a* and 18*b* are of a length which causes a friction fit between holder 10 and bore 122, thereby holding holder 10 in place within bore 122. The slight taper in holder 10 between ends 18*a* and 18*b* and ends 19*a* and 19*b* reduces the contact area between the sides of holder 10 and bore 122 and, consequently, the amount of friction between holder 10 and bore 122. This makes it easier to push holder 10 and pin 218 through housing means 114 with plunger 116. Although the taper of holder 10 reduces the amount of friction between holder 10 and bore 122, by preventing the sides of holder 10 from being parallel and directly in contact with bore 122, pin 218 is still sufficiently held in alignment with the direction of travel plunger 116 as it pushes the holder and pin into the locknut 112. Any misalignment caused by the sides of holder 10 not being parallel to bore 122 is negligible and does not affect the function of piercing instrument 100.

Figure 6:
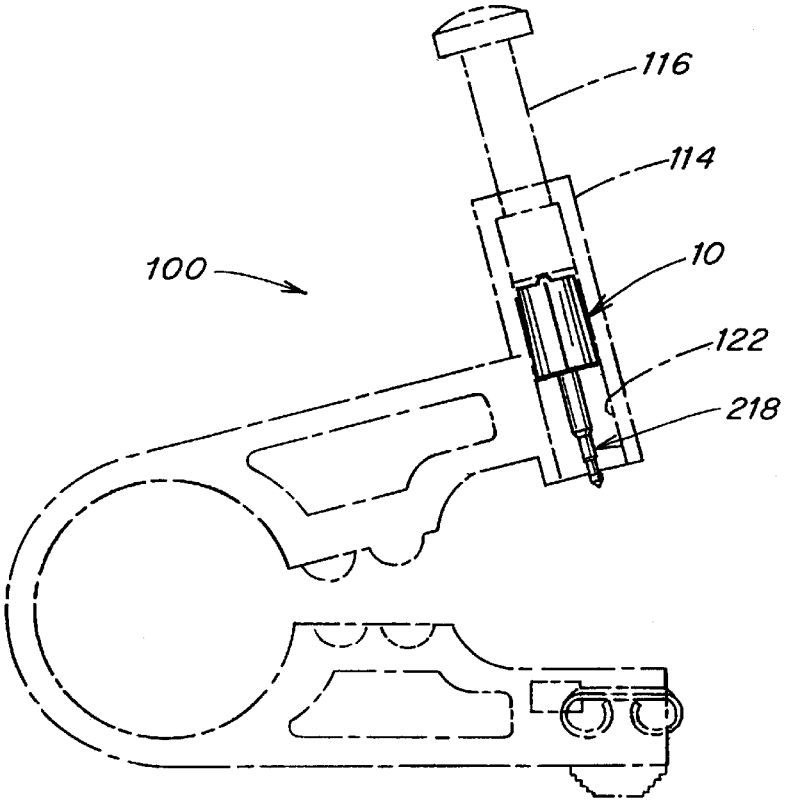
FIG. 6 is a plan view of the piercing instrument with the body piercing pin holder of the present invention installed.

FIG. 6 shows holder 10 and pin 218 mounted within bore 122 of housing means 114 of piercing instrument 100, shown in phantom.

Holder 10 and pin 218 may be inserted into housing means 114 of piercing instrument 100 before packaging, so that they can be sterilized and packaged as a unit, thereby eliminating the need for the user to fit holder 10 and pin 218 into piercing instrument 100. This reduces the possibility of contaminating the sterilized unit.

In the preferred embodiment, the head of pin of 218 is ball-shaped, and indentations 14*a* and 14*b* are semispherically-shaped. However, any shape head may be used and the shape of indentations 14*a* and 14*b* may vary to correspond to the shape of the head of the piercing pin.

Furthermore, while the example described in the disclosure is directed to a pin holder for an ear lobe piercing instrument, the disclosed instrument and holder are not limited to piercing ear lobes, and may be used to pierce any pierciable body part. Having thus described at least one illustrative embodiment of the invention, various alterations, modifications, and improvements will readily occur to those skilled in the art. Such alteration, modifications and improvements are intended to be in the spirit and scope of the invention. Accordingly, the foregoing is by way of description is by way of example only and is not intended as limiting. The invention is limited only as defined in the following claims and the equivalence thereto.

What is claimed is:

1. A holder and a body piercing pin for use in a body piercing instrument that includes a housing having a bore shaped to receive the holder and a plunger slidable within the bore for engagement with said holder, said holder comprising two symmetrical halves interengaged at one end by a hinge and when folded defining a substantially cylindrical shape sized to slidably fit within a bore of the body piercing instrument and move therethrough when urged by a plunger, said holder when folded defining a cavity with an opening extending axially therefrom at the end opposite the hinge and said body piercing pin having a head shaped and sized to conform with and engage said cavity in fixed relation thereto and with a shaft extending from said head outwardly from said housing through said axial opening.

2. A holder and body piercing pin as set forth in claim 1 wherein the cavity formed by said holder is spherical in shape and said head is also spherical in shape.

* * * * *